US007175387B2

(12) United States Patent
Kreis et al.

(10) Patent No.: US 7,175,387 B2
(45) Date of Patent: Feb. 13, 2007

(54) SEAL ARRANGEMENT FOR REDUCING THE SEAL GAPS WITHIN A ROTARY FLOW MACHINE

(75) Inventors: Erhard Kreis, Otelfingen (CH); Markus Oehl, Waldshut-Tiengen (DE); Ulrich Rathmann, Baden (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 10/808,490

(22) Filed: Mar. 25, 2004

(65) Prior Publication Data

US 2004/0179937 A1 Sep. 16, 2004

Related U.S. Application Data

(63) Continuation-in-part of application No. PCT/IB02/03862, filed on Sep. 19, 2002.

(30) Foreign Application Priority Data

Sep. 25, 2001 (CH) ..... 1766/01

(51) Int. Cl.
*F01D 11/00* (2006.01)

(52) U.S. Cl. ..... 415/139; 415/138; 415/173.7; 415/174.2; 415/174.4; 415/191; 415/208.2; 277/628; 277/637; 277/650; 277/653; 277/654; 277/941

(58) Field of Classification Search ..... 415/130–139, 415/170.1, 173.7, 174.2, 191, 208.2, 174.4; 416/193 A, 198 A, 248; 277/628, 653, 637, 277/650, 654, 941
See application file for complete search history.

(56) References Cited

U.S. PATENT DOCUMENTS 3,801,220 A * 4/1974 Beckershoff ..... 416/198 A
4,257,741 A 3/1981 Betts et al.
4,422,827 A * 12/1983 Buxe et al. ..... 416/193 A
4,580,946 A 4/1986 Bobo
4,655,687 A 4/1987 Atkinson
4,884,951 A 12/1989 Meylan et al.
5,167,485 A * 12/1992 Starkweather ..... 415/139
5,277,548 A 1/1994 Klein et al.

(Continued)

FOREIGN PATENT DOCUMENTS

DE 33 03 482 A1 8/1983

(Continued)

OTHER PUBLICATIONS

IPER from PCT/IB02/03862 (Sep. 5, 2003).*

(Continued)

*Primary Examiner*—Christopher Verdier
(74) *Attorney, Agent, or Firm*—Cermak & Kenealy, LLP; Adam J. Cermak

(57) ABSTRACT

A seal arrangement for reducing the seal gaps within a rotary flow machine, preferably an axial turbomachine, has rotor blades and guide vanes, which are respectively arranged in at least one rotor blade row and guide vane row and have respective blade/vane roots (2,3) which protrude into fastening contours within the rotor blade and guide vane rows. A sealing element (4) of plastically deformable material is provided between at least two adjacent blade/vane roots (2,3) along a rotor blade row or guide vane row or between a blade/vane root (2,3) of a rotor blade or guide vane and a rotary flow machine component directly adjoining the blade/vane root.

16 Claims, 3 Drawing Sheets

U.S. PATENT DOCUMENTS

| | | | | |
|---|---|---|---|---|
| 5,464,326 | A | 11/1995 | Knott | |
| 6,312,218 | B1 * | 11/2001 | Beeck et al. | 416/193 A |
| 6,499,943 | B1 * | 12/2002 | Beeck et al. | 415/115 |

FOREIGN PATENT DOCUMENTS

| | | | |
|---|---|---|---|
| DE | 195 20 268 | A1 | 12/1996 |
| DE | 198 48 103 | A1 | 4/2000 |
| DE | 198 58 031 | A1 | 6/2000 |
| EP | 0 501 700 | A1 | 9/1992 |
| EP | 0 787 890 | A2 | 8/1997 |
| EP | 0 787 890 | A3 | 4/1999 |
| EP | 0 995 881 | A2 | 4/2000 |
| EP | 1 076 157 | A2 | 2/2001 |
| FR | 1340331 | | 9/1963 |
| WO | 03/027445 | A1 | 4/2003 |

OTHER PUBLICATIONS

Search Report from CH 2001 1766/01 (Dec. 13, 2001).
Search Report from PCT/IB02/03862 (Nov. 7, 2002).

* cited by examiner

SEAL ARRANGEMENT FOR REDUCING THE SEAL GAPS WITHIN A ROTARY FLOW MACHINE

This application is a Continuation-in-Part of, and claims priority under 35 U.S.C. § 120 to, International patent application number PCT/IB02/03862, filed 19 Sep. 2002, and claims priority under 35 U.S.C. § 119 to Swiss patent application number 2001 1766/01, filed 25 Sep. 2001, the entireties of which are incorporated by reference herein.

TECHNICAL FIELD

The invention relates to a seal arrangement for reducing the seal gaps within a rotary flow machine, preferably an axial turbomachine. Such an arrangement is disclosed in DE-A1-198 48 103.

PRIOR ART

Seal arrangements of the generic type are sufficiently known and are used for a substantially gas-tight connection between two rotor blades or guide vanes, which are firmly arranged adjacent to one another longitudinally in a blade/vane row and which are employed in rotary turbo machines for the compression or expansion of gaseous media, depending on whether a compressor unit or a gas turbine unit is involved. Rotor blades and guide vanes adjoin one another by means of platforms, which are arranged directly at the blade/vane root region and separate the region of the working medium from an installation region which has to be cooled, either the rotor arrangement or the casing regions of the rotary turbo machine. Intermediate pieces can also be introduced as distance elements between two blade/vane roots along a blade/vane row and these likewise adjoin the platforms of the blade/vane roots by means of corresponding side flanks. It is precisely these abutting surfaces of mutually adjoining platforms of two adjacent blade/vane roots or blade/vane roots and distance elements which have to be sealed as effectively as possible relative to one another in order to avoid leakage flows. For simplicity, reference is made in what follows to adjoining blade/vane roots and the associated seal gaps but by this is meant the above relationships.

DE-A-198 48 103 describes a seal arrangement for reducing leakage flows within a rotary flow machine, preferably an axial turbomachine, having rotor blades and guide vanes, which are respectively arranged in at least one rotor blade row and guide vane row and have blade/vane roots, via which the individual rotor blades and guide vanes are connected to fastening contours. The embodiment is distinguished by the fact that a sealing element having a felt-like material is provided between at least two adjacent blade/vane roots within a guide vane row or rotor blade row or between guide vanes and or rotor vanes and adjacent components of the flow machine.

EP-A-1 076 157 relates to the provision of a turbine blade of a gas turbine with an intermetallic felt. By covering the tips of the turbine blades with the intermetallic felt and a coating with a ceramic material, improved protection against thermal and mechanical effects and improved oxidation resistance can be achieved. An arrangement of the intermetallic felt on the rotor or stator lying opposite the turbine blade or on the platform of the turbine blade is also conceivable.

DE-A-198 58 031 concerns an abradable seal between a wall portion and the blade/vane tips of a gas turbine, which consist completely of a foamed, metallic corrosion-resistant high-temperature alloy. According to a first production method, prefabricated metal foam segments are connected to the wall portions by high-temperature soldering. Alternatively, the unfoamed raw material of the abradable seal may be initially connected to the wall portions and subsequently foamed onto them. Such metal foam seals have optimum sealing behavior, with simultaneous improvement of the insulation of the housing structure from the hot gas. By influencing the foaming parameters, the cell structure of the abradable seal can be influenced within certain limits, so that the running-in properties, the hindrance of surrounding flow and the insulating effect are determined in this way.

In this connection, EP 0 501 700 A1 reveals a turbine guide vane construction in which the guide vane root and tip shroud are fixed relative to corresponding contours of the casing components by means of spring sealing elements. The disadvantage of seals provided with spring elements consists inter alia in the fact that it is impossible to exclude the possibility that the spring material may very rapidly fatigue because of the generally high material stresses in terms of the temperature and pressure conditions present in gas turbines. They therefore lose their spring force and, in consequence, their sealing function.

In addition, DE 195 20 268 A1 reveals a surface seal with two sealing surfaces which respectively include an elastic corrugated surface. In an embodiment example, the U-shaped surface seal extends along the inner contour of a guide vane root of hammerhead-type configuration and is used for the sealing of cooling air, which is blown into the guide vane, and for the protection of the guide vane root from hot gases. The seal arrangement which has to be configured in different surface shapes does, however, require flat contour surfaces which have to be sealed and with which they can make surface contact. If this involves the sealing of intermediate gaps which are enclosed by curved surfaces, the known seal arrangement meets its limits.

DE 33 03 482 A1 describes a rotor subassembly within which the rotor blades adjoin one another by means of the respective shrouds or platforms. In order to seal, in a substantially complete manner, leakage flows between residual intermediate gaps which appear between the adjoining rotor blade platforms, it is proposed that silicone rubber strips should be provided which are attached to the lower surface of the rotor blade platforms in order to seal the intermediate gap, at least on the lower surface of the adjoining rotor blade platforms. For this purpose, the silicone rubber strips are bonded to the lower surface of a rotor blade platform and, in the process, overlap the surface of the adjacent rotor blades. Due to the bonding and due to the centrifugal force acting on the silicon rubber strips because of rotation, the intermediate gap between the adjacent rotor blade platforms can be substantially sealed. A disadvantageous feature of the use of silicone seals is their limited temperature resistance, because of which their use appears questionable in high-performance gas turbines, in which temperatures of up to 1200° C. are present.

The prior art examples indicated above for reducing the seal gap between two rotor blades or guide vanes arranged along a rotor blade row make it clear that despite the number of known solution concepts, shortcomings with respect to the reduction of the peripheral gap in blade/vane rows remain. The difficulties occurring with these solutions are associated with the generally high operating temperatures, particularly in the operation of gas turbine installations, due to which sealing aids for reducing the individual seal gaps, which are known, can involve substantial difficulty and finally lose their initial sealing function.

Further difficulties arise because the different thermal expansion properties of the individual installation components, in particular that of the rotor blades and guide vanes in their blade/vane root regions, depend very strongly on the temperatures present there. If, for example, two blade/vane roots adjacently arranged within a blade/vane row are pressed against one another in the "cold" condition with a minimally small seal gap and are fixed in this position, such high compressive forces occur between adjacent blade/vane roots in the peripheral direction of the blade/vane row during rated load operation of the rotary flow machine, due to thermally caused material expansions, that structural overload can be caused in the joint region between each individual blade/vane root and the respective fastening groove, which can be the cause of premature material fatigue and, in the end, to a total loss of a blade/vane.

If, on the other hand, the intermediate gap between two adjacent blade/vane roots is selected to be excessively large in the cold condition, large intermediate gaps are present, despite thermally caused material expansions, in the rated operating condition of the rotary flow machine, of a gas turbine installation for example, through which leakage flows of substantial magnitude pass and therefore cause noticeable power losses.

The relationships described above make it clear that, in order to achieve the most optimum possible minimum seal gap between two adjacent blade/vane roots along a blade/vane row, seal gaps have to be provided in the cold condition whose dimensions have to be set extremely precisely, with very tight tolerance limits, in order to achieve a desired minimum seal gap in the hot condition.

Because of the technical requirements and the thermal expansion properties—which cannot be exactly determined in advance—of the individual components, however, this cannot be realized in the desired manner. In addition, oxidation phenomena on the flanks or edges of the blade/vane roots during operation contribute to the fact that seal gap distances originally dimensioned in an optimum manner experience substantial deviations in the cold condition. As a result, undesirable changes occur within the seal gap which can lead to very high compression forces between two adjacent blade/vane roots in the hot condition—and therefore to structural overloads, as mentioned previously.

PRESENTATION OF THE INVENTION

An aspect of the invention is based on the object of developing a seal arrangement for reducing the seal gaps within a rotary flow machine, preferably an axial turbomachine, having rotor blades and guide vanes, which are respectively arranged in at least one rotor blade row and guide vane row and have respective blade/vane roots which protrude into fastening contours within the rotor blade and guide vane rows, in such a way that, during the hot operating behavior of the turbomachine, an optimum minimum seal gap forms between two adjacent blade/vane roots, which seal gap reduces a possibly existing leakage flow effectively and in an optimum manner, on the one hand, and, on the other, does not cause any compressive forces, between the blade/vane roots, which stress—in a damaging fashion—the blade/vane roots fastened in the peripheral direction of a blade/vane row. The seal arrangement should, furthermore, be resistant to high temperature and oxidation and, in consequence, have a long life.

In contrast to the previously known solution approaches, in which two adjacent blade/vane roots are joined together as firmly and intimately as possible, the invention is based on the idea of joining two adjacent blade/vane roots to one another loosely in such a way that even in the hot condition, the blade/vane roots are not subjected to any compressive forces (which lead to mechanical stresses in the blade/vane roots) but, nevertheless, enclose between them a seal gap which is the minimum possible.

This is realized, according to the invention, by the use of a plastically easily deformable material, which is introduced in a targeted manner between two adjacent blade/vane roots and preferably has a material thickness which is dimensioned in such a way that, in the cold condition, the two blade/vane roots are at a distance from one another by means of a cold gap of the usual order of value, which can be manufactured, of approximately 1/100 mm to 5 mm. Because the individual blade/vane roots are fixed within the fastening contour along the blade/vane row in the peripheral direction, the respective seal gap enclosed between two adjacent blade/vane roots is reduced during the operation of the turbomachine, preferably a gas turbine machine, because of the high operating temperatures occurring and the material thermal expansion within the blade/vane roots initiated by the high operating temperatures. Due to the material expansion, the side flanks of the blade/vane roots move toward one another, come into contact and, because of further expansion, are able to plastically deform the material introduced between the two blade/vane roots so that a certain proportion of the material is genuinely "squeezed" out of the seal gap and/or is subjected to a local material compression, depending on the plastic deformation behavior of the material. In this way, the compressive forces emerging from two opposing blade/vane roots are accepted by the plastically deformable sealing element itself and are not transmitted to the respectively opposite blade/vane root. Due to the plastic deformation of the sealing element, a hot gap which is as small as possible appears automatically, independently of the current operating conditions and the tolerance originally provided in the dimensioning of the cold seal gaps and corresponding sealing elements.

In addition to the reduction in the seal gaps between adjacent blade/vane roots, the plastically deformable material is also to be provided between components of the rotary flow machine such as distance intermediate pieces along a guide vane or rotor blade row or heat insulation segments, the so-called heat shields.

Sintered metals, metal foams and porous metallic coating materials can preferably be used as plastically deformable materials.

Sintered metals, which are present in the original form as powdered nickel aluminite, iron aluminite or cobalt aluminite and which can be preferably applied by means of a flame spray process under high pressure onto at least one of two opposing flanks of a blade/vane root, represent preferred oxidation-resistant sealing materials.

The use of metal foams is also conceivable in the form of nickel or nickel alloy foams, cobalt or cobalt alloy foams, aluminum or aluminum alloy foams, or combinations thereof. These can be applied by means of a brazing/soldering or welding process to the respective side flank of a blade/vane root and can be permanently joined to the latter.

The use of metallic porous coatings, such as the provision of so-called MCrAlY layers, where M is selected as an element of the group consisting of iron, cobalt and nickel, is also particularly suitable as sealing materials in the sense outlined above. Such material compounds can likewise be applied by means of the flame spray to the surface of a flank of a blade/vane root. Different porosities can be specifically adjusted as a function of the selection of suitable spray parameters, by which means the degree of plasticity can be almost arbitrarily adjusted.

Fundamentally, any oxidation-resistant, plastically deformable materials can be used for the application purpose quoted above; they can be appropriately joined to the blade/vane roots by means of flame spraying, galvanic precipitation, vacuum coating, plating or by the use of brazing/soldering and welding techniques.

Another aspect of invention includes that a sealing element is firmly connected to at least one platform.

Another aspect of invention includes that a sealing element is connected to a platform by a bonded connection.

Another aspect of invention includes that a sealing element and a platform form a metallurgical combination.

Another aspect of invention includes that a sintered metal includes a homogeneously baked combination of NiAl, FeAl, or CoAl.

Another aspect of invention includes that plastic deformation of a sealing element takes place substantially laterally relative to a place of a seal gap.

Another aspect of the present invention includes that a platform or platforms and a component when directly adjoining the platform have a contour protruding into one another, a sealing element positioned at least on a contour part facing toward the aerofoils.

Another aspect of the present invention includes that there is at least one cooling duct.

BRIEF DESCRIPTION OF THE FIGURES

The invention is described below, as an example and without limitation to the general idea of the invention, using exemplary embodiments and with reference to the drawings. In these.

WAYS OF CARRYING OUT THE INVENTION, COMMERCIAL APPLICABILITY

Figure 1A:
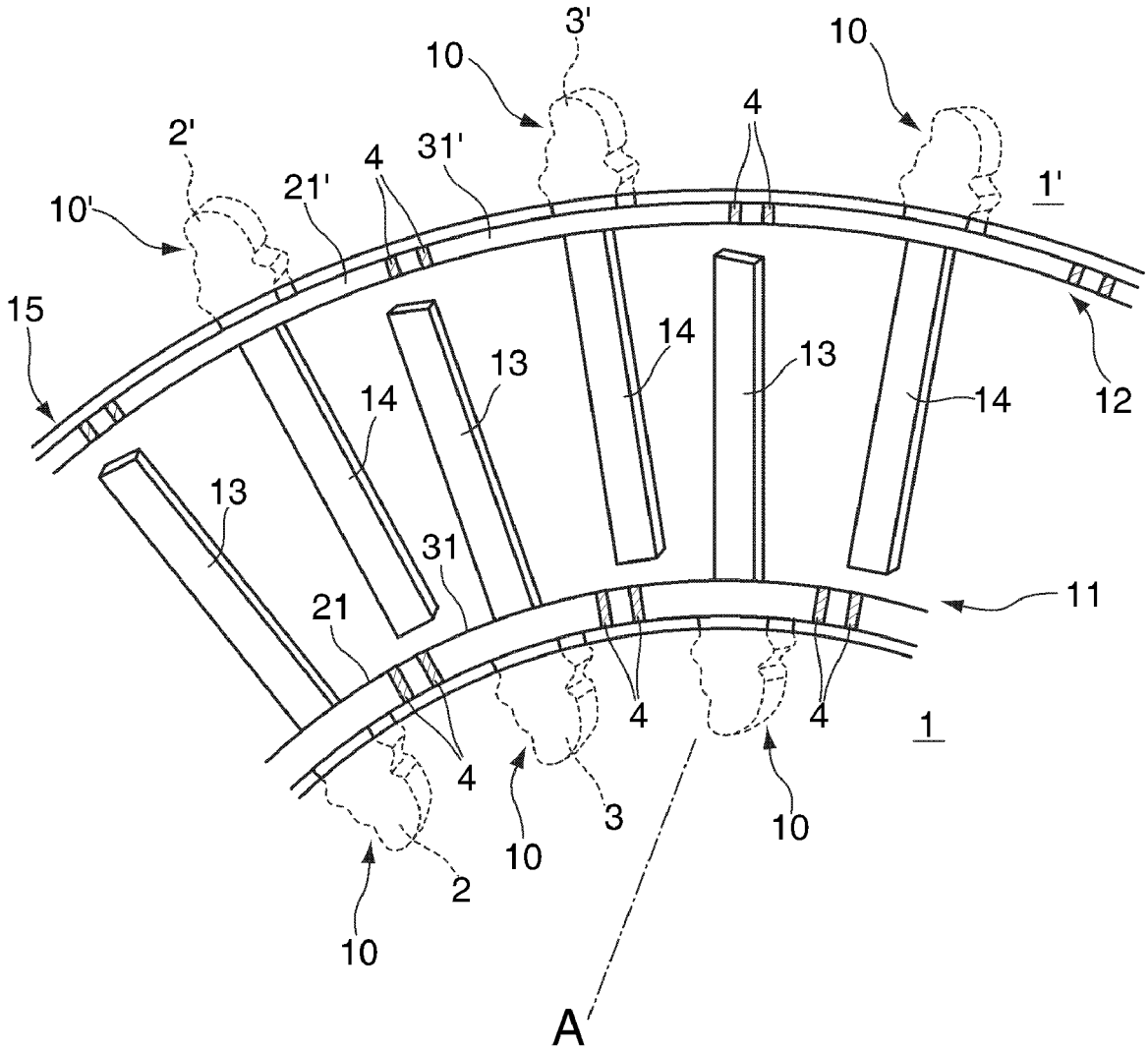
FIG. 1*a* illustrates a schematic view of a turbine stage of an axial turbomachine having at least one blade row and at least one guide vane row.

FIG. 1*a* shows an extract of an axial turbomachine in which at least one rotor blade row 11 and at least one guide vane row 12 is provided. Both rows 11, 12 are separated axially from each other along an axis A of the axial turbomachine. The turbomachine provides rotor blades 13 and guide vanes 14 arranged in at least one of the rotor blade rows 11 and guide vane rows 12 and have respective blade roots 2, 3 or vane roots 2', 3' which protrude into fastening contours 10, 10' within the rotor arrangement 1 and stator housing arrangement 1'. A sealing element 4 of plastically deformable material is provided between a blade root 2, 3 or vane root 2', 3' or guide vane row and rotary flow machine component 15, like an intermediate piece or a heat insulation segment, directly adjoining the blade root or vane root.

Figure 1B:
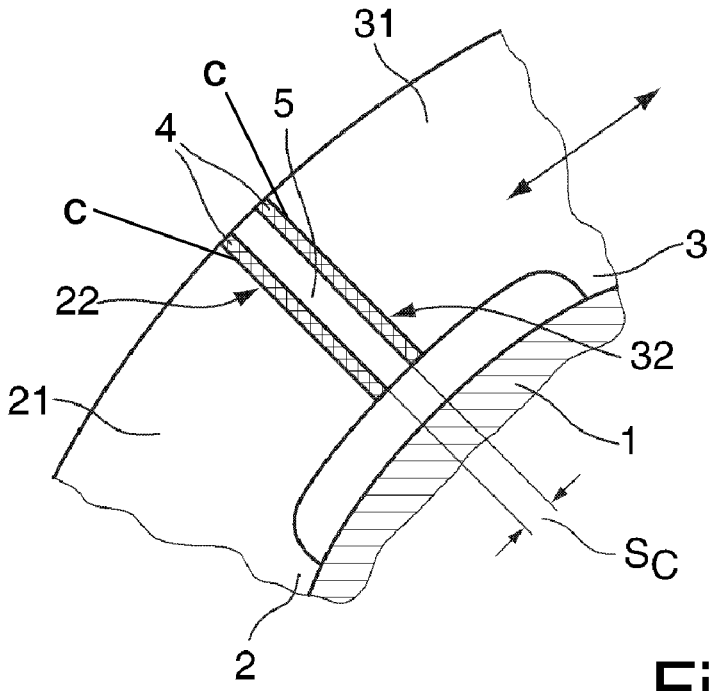
FIGS. 1*b, c* show a diagrammatic excerpt from a cross section of two inner shrouds, opposite to one another, of two blade/vane roots.

FIG. 1*b* represents a partial cross-sectional representation through two immediately adjacent opposite platforms 21, 31 of two blade roots 2, 3, which extend in the peripheral direction (see arrow) on a rotor/stator arrangement 1 and which protrude for fastening purposes into the arrangement 1.

FIG. 1*b* shows the cold condition, i.e., the condition of the blade roots 2, 3 before the commissioning of the rotary flow machine, which represents, for example, a compressor unit or a gas turbine stage. A layer-shaped sealing element 4 consisting of plastically deformable material is respectively provided on the two flanks 22, 32 directly opposite to one another of the platforms 21, 31, e.g., by a brazed, soldered, or bonded connection C. These sealing elements 4 jointly enclose a cold gap 5 with a cold gap width $s_c$. The cold gap width $s_c$ has, typically, a distance apart of between 0.01 and 5 mm.

Figure 1C:
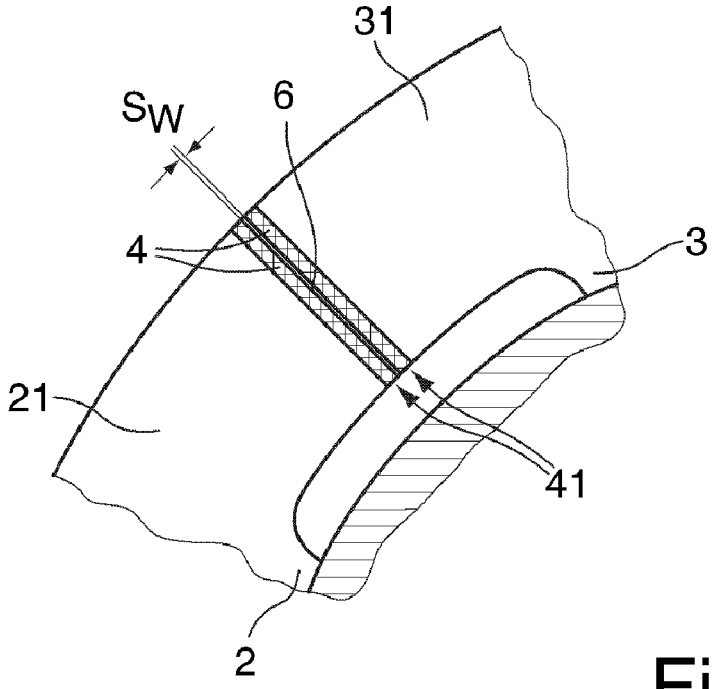

FIG. 1*c* shows the same arrangement in the hot condition, i.e., after the thermal expansion of the two opposite blade roots 2, 3 with the platforms 21, 31 has already taken place. The two sealing elements 4 are joined to one another under the action of forces and are at least partially plastically deformed because of the joining forces which are present and by means of which their effective material thickness has been reduced. At the edge regions of the two plastically deformed layers 4 of FIG. 1, lateral squeeze regions 41 have formed which, because of the plastic deformation, also remain after return to the cold condition.

Due to the provision of plastically deformable materials, according to the invention, between two blade roots immediately adjacent to one another, preferably between the adjacent platforms 21, 31 of the two blade roots 2, 3, an optimum minimum hot gap 6 forms in the hot condition. This has a gap width $s_w$ which, in the best case, is close to zero and is, in any event, substantially smaller than the cold gap $s_c$.

Figure 2:
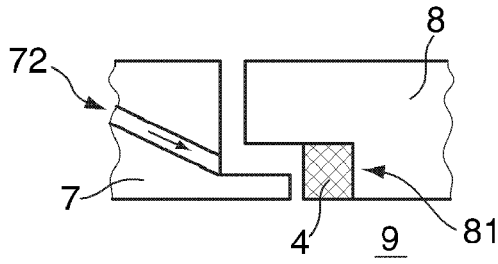
FIGS. 2, 3, 4 show alternative embodiment forms.

Two contoured flanks of two platforms 7, 8 of guide vanes are shown in FIG. 2. These bound, relative to a stator casing (not shown), a hot gas duct 9 within a gas turbine installation. In this case also, a part of the platform flank 81 has a sealing element 4 consisting of plastically deformable material, against which a corresponding protrusion of the platform 7 is pressed and which is, at the same time, cooled by a cooling duct 72.

Figure 3:
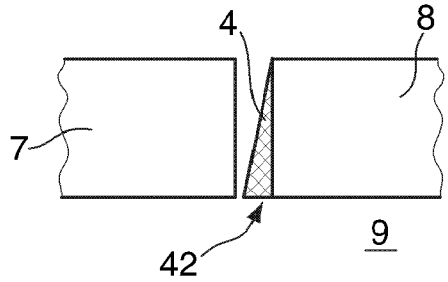

FIG. 3 shows a corresponding arrangement, in which two platforms 7, 8 are joined together by means of a wedge-shaped configuration of the sealing element 4. The larger wedge end 42 of the wedge-shaped sealing element 4 is oriented toward the hot gas duct 9 sides.

Figure 4:
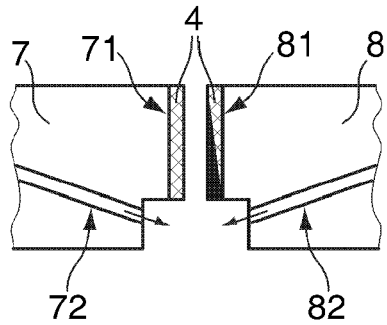

FIG. 4, finally, represents a further alternative embodiment of two platforms 7, 8, which are located opposite to one another and in which two opposite flanks 71, 81 are joined by corresponding sealing elements 4. Additional cooling ducts 72, 82 ensure corresponding local cooling.

Figure 5:
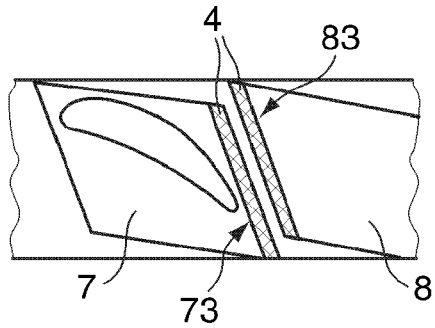
FIG. 5 shows a diagrammatic plan view onto two guide vanes, with sealing elements, arranged adjacent to one another in a guide vane row.

FIG. 5 shows the plan view onto two guide vanes with associated platforms, arranged along a guide vane row, which platforms are arranged one beside the other along the two side edges 73, 83. In this arrangement, the sealing elements 4 provided on the two side flanks 73 and 83 are dimensioned in such a way that a hot gap appears which is as uniformly minimum as possible. This is made more difficult by the occurrence of tipping of the two platforms 7, 8, relative to one another. This can, however, be taken into account by an appropriate choice of layer thickness for the sealing elements 4.

Figure 6:
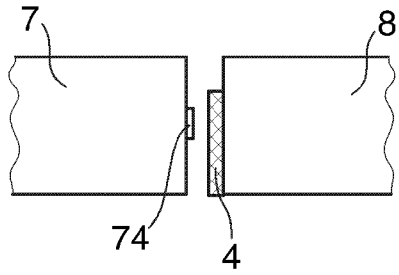
FIG. 6 shows an alternative embodiment.

FIG. 6 shows a further alternative embodiment which is comparable to FIGS. 2 to 4. The platform flank of the guide vane has a raised sealing protrusion 74 which is pressed locally into the sealing element 4 opposite to it. This produces a local, simple plastic deformation within the sealing element 4, by means of which the leakage flow can be effectively suppressed.

As described above, each of the foregoing the adjoining pieces 7, 8 to be sealed can also be rotary machine components and/or vane or blade root platforms.

LIST OF DESIGNATIONS

1 Rotor arrangement
1' Stator housing arrangement
2, 2', 3, 3' Blade/vane root
21, 21', 31, 31' Platform
22, 32 Side flanks
4 Plastically deformable material, sealing element
41 Squeeze region
42 Wedge end
5 Sealing gap (cold gap)
6 Sealing gap (hot gap)
7, 8 Platform
71, 81 Side flanks of platform 7,8
72, 82 Cooling ducts
73, 83 Side flanks
74 Sealing protrusion
9 Hot gas duct
10, 10' Fastening contour
11 Rotor blade row
12 Guide vane row
13 Blade
14 Guide vanes
15 Machine component
C Connection

The invention claimed is:

1. A seal arrangement for reducing the seal gaps within a rotary flow machine, the seal arrangement comprising:

rotor blades and guide vanes arranged in at least one rotor blade row and at least one guide vane row, respectively, each rotor blade and guide vane having blade roots and vane roots which are fastened to the rotor blade rows and guide vane rows, respectively;

the blade roots and vane roots each having a respective platform;

a sealing element comprising a plastically deformable material positioned (a) between at least two platforms of adjacent blade roots and vane roots along a rotor blade row, or (b) between at least two platforms of adjacent blade roots and vane roots along a guide vane row, or (c) between a platform of either a blade root or a vane root and a rotary flow machine component when directly adjoining the platform;

the sealing element being firmly connected to at least one platform and having a thickness protruding from the surface of the at least one platform;

said at least two adjacent platforms or said platform and said component when directly adjoining the platform enclose a cold gap $s_c$ in a cold condition and a hot gap $s_w$ in a hot condition during operation of the rotary flow machine; and wherein the plastically deformable material comprises a sintered metal comprising a homogeneously baked combination from NiAl, FeAl, or CoAl.

2. The seal arrangement as claimed in claim 1, wherein the sealing element is configured and arranged so that, when a contact pressure present between two platforms or between the platform and said component when directly adjoining the platform is exceeded in the hot condition of the rotary flow machine, the sealing element deforms plastically in order to form a minimum hot gap $S_w$.

3. The seal arrangement as claimed in claim 2, further comprising:

a seal gap enclosed by both platforms or by the platform and the component when directly adjoining the platform, the seal gap defining a plane; and wherein the sealing element is configured and arranged so that the plastic deformation of the sealing element takes place substantially laterally relative to the plane of the seal gap.

4. The seal arrangement as claimed in claim 1, wherein the rotor blades and guide vanes each comprise an aerofoil, and wherein the sealing element has a wedge-shaped portion including a thicker wedge end oriented to be facing toward the aerofoils.

5. The seal arrangement as claimed in claim 1, wherein the rotor blades and guide vanes each comprise an aerofoil, and wherein the platforms or the platform and the component when directly adjoining the platform have a contour protruding into one another, the sealing element positioned at least on a contour part facing toward the aerofoils.

6. The seal arrangement as claimed in claim 1, further comprising:

at least one cooling duct opening from the platform in the region of the sealing element.

7. The seal arrangement as claimed in claim 1, further comprising:

a sealing protrusion on the platform opposite the sealing element.

8. The seal arrangement as claimed in claim 1, further comprising:

said component of the rotary flow machine adjoining the platform including an intermediate piece comprising a distance piece or a heat insulation segment.

9. The seal arrangement as claimed in claim 1, wherein said rotary flow machine comprises an axial turbomachine.

10. A seal arrangement for reducing the seal gaps within a rotary flow machine, the seal arrangement comprising:

rotor blades and guide vanes arranged in at least one rotor blade row and at least one guide vane row, respectively, each rotor blade and guide vane having blade roots and vane roots which are fastened to the rotor blade rows and guide vane rows, respectively;

the blade roots and vane roots each having a respective platform;

a sealing element comprising a plastically deformable material positioned (a) between at least two platforms of adjacent blade roots and vane roots along a rotor blade row, or (b) between at least two platforms of adjacent blade roots and vane roots along a guide vane row, or (c) between a platform of either a blade root or a vane root and a rotary flow machine component when directly adjoining the platform;

the sealing element being firmly connected to at least one platform and having a thickness protruding from the surface of the at least one platform;

said at least two adjacent platforms or said platform and said component when directly adjoining the platform enclose a cold gap $s_c$ in a cold condition and a hot gap $s_w$ in a hot condition during operation of the rotary flow machine; and wherein $s_w << s_c$.

11. The seal arrangement as claimed in claim 10, further comprising:

a brazed connection, a soldered connection, or a bonded connection, connecting the sealing element to the platform.

12. The seal arrangement as claimed in claim 10, wherein the sealing element is applied to a platform as a layer material by a precipitation process; and wherein the sealing element and said platform form a metallurgical combination.

13. The seal arrangement as claimed in claim 12, wherein the sealing element is configured and arranged as a layer material capable of being applied by flame spraying, galvanic precipitation, or by plating onto the platform.

14. The seal arrangement as claimed in claim 10, wherein plastically deformable material comprises a sintered metal, a metal foam, or a porous metallic coating.

15. The seal arrangement as claimed in claim 14, wherein the metal foam comprises at least one element selected from the group consisting of Ni, Co, Al, and combinations thereof.

16. The seal arrangement as claimed in claim 14, wherein the porous metallic coating comprises MCrAlY, wherein M is a metal selected from the group consisting of Ni, Co, and Fe.

* * * * *